US006258206B1

(12) United States Patent
Olausson et al.

(10) Patent No.: US 6,258,206 B1
(45) Date of Patent: Jul. 10, 2001

(54) PROCESS FOR PURIFYING CONDENSATE WHILE EVAPORATING WASTE LIQUORS

(75) Inventors: Lars Gunnar Olausson, Angered; Lars Eric Pettersson, Göteborg; Olof Tryggve Wennberg, Göteborg; Anders Henrik Wernqvist, Göteborg, all of (SE)

(73) Assignee: Kvaerner Pulping AB (SE)

( * ) Notice: Subject to any disclaimer, the term of this patent is extended or adjusted under 35 U.S.C. 154(b) by 0 days.

(21) Appl. No.: 09/065,086

(22) PCT Filed: Oct. 21, 1996

(86) PCT No.: PCT/SE96/01337

§ 371 Date: Aug. 19, 1998

§ 102(e) Date: Aug. 19, 1998

(87) PCT Pub. No.: WO97/16592

PCT Pub. Date: May 9, 1997

(30) Foreign Application Priority Data

Nov. 1, 1995 (SE) ..... 9503853

(51) Int. Cl.[7] ..... B01D 1/26; B01D 3/00; D21C 11/10; D21C 11/06

(52) U.S. Cl. ..... 159/47.3; 159/13.2; 159/16.3; 159/17.1; 159/49; 159/DIG. 8; 162/29; 162/46; 162/47; 202/173; 202/174; 202/202; 203/72; 203/78; 203/79

(58) Field of Search ..... 159/47.3, DIG. 8, 159/16.3, 17.1, 49, 13.1, 13.2, 27.1, 27.4; 203/79, 72, 78, 80; 162/46, 47, 68, 30.1, 29, 31; 202/174, 173, 202

(56) References Cited

U.S. PATENT DOCUMENTS

| | | | | |
|---|---|---|---|---|
| 3,763,020 | | 10/1973 | Drew et al. . | |
| 4,216,002 | * | 8/1980 | Rosenblad | 203/87 |
| 4,333,800 | * | 6/1982 | Henricson | 202/236 |
| 4,756,797 | * | 7/1988 | Elmore et al. | 159/13.1 |
| 4,925,526 | * | 5/1990 | Havukainen | 159/13.3 |
| 5,139,620 | * | 8/1992 | Elmore et al. | 203/72 |
| 5,380,402 | * | 1/1995 | Ryham et al. | 162/30.1 |
| 5,382,321 | * | 1/1995 | Fägerlind et al. | 159/47.3 |
| 5,830,314 | * | 11/1998 | Mattson | 162/46 |

FOREIGN PATENT DOCUMENTS 31 20 586 A1 5/1981 (DE) .

* cited by examiner

*Primary Examiner*—Virginia Manoharan
(74) *Attorney, Agent, or Firm*—Fasth Law Offices; Rolf Fasth

(57) ABSTRACT

A process for evaporating spent liquor or other waste liquids from cellulose cooking, The evaporation is performed in a multiplicity of evaporators which are coupled in series and in which the evaporation is driven using the liquor steam. The condensates from the steam are divided, in one of more effects, into at least two fractions with respect to purity. The parer fraction from one effect is conveyed, at a high level, into a subsequent effect in the direction of movement of the liquor, while the dirtier fraction is conveyed, at a high level or at the very top, into a preceding effect in the direction of movement of the liquor.

6 Claims, 2 Drawing Sheets

PROCESS FOR PURIFYING CONDENSATE WHILE EVAPORATING WASTE LIQUORS

TECHNICAL FIELD

The present invention relates to the evaporation of spent liquor or other waste liquids, such as black liquor, sulphite liquor or bleaching department filtrate, from cellulose cooking, and the process relates to an evaporation process which yields a purer condensate of the evaporated liquid and a second condensate of the evaporated liquid which is more concentrated with regard to impurities.

STATE OF THE ART

Spent liquor from cellulose cooking, so-called black liquor, has a dry substance content of 14–17%. These substances are cooking chemicals which are to be recovered and organic substances, principally lignin residues, which are to be combusted. Direct combustion of black liquor is not possible, due to this low concentration of solid substances; for this reason, the black liquor has to be concentrated by evaporating off water. This evaporation takes place in various devices and results in a concentrated black liquor whose concentration is of the order of 80%. This concentrated black liquor is then combusted in a recovery boiler, with chemicals and heat energy being recovered.

The evaporation normally takes place in a series of appliances which are in principle constructed as heat exchangers. They consist of a cylindrical container of substantial height, for example 9–13 meters, and are provided internally with heat-exchanger tubes or heat-exchanger plates. In a preferred embodiment, the heat exchanger consists of a tube assembly which is placed vertically between two tube plates through which holes are bored directly opposite the tube ends so that liquid, i.e. black liquor, can be caused to flow vertically down inside the tubes, with steam, which is to bring about the evaporation, being allowed to flow and condense on the outside of the tubes. The tube ends are joined to the tube plates such that there is no connection between the inside and outside, respectively, of the tubes. The black liquor consequently forms a falling film inside the tubes and releases a portion of its water content in the form of steam, so-called liquor steam, which is used as a heating medium in other appliances. Such an appliance is termed a falling film evaporator. Normally, several such appliances are coupled in series. While they can be arranged in such a manner that the liquor flows in countercurrent to the steam, co-current devices are also known. In these latter devices, it is customary to have heat exchangers between the evaporation appliances in order to increase the temperature of the liquor.

The water which is evaporated in an evaporation appliance, a so-called effect, is released in steam form and is used for evaporation in another, subsequent, effect containing weaker liquor. Most of the liquor steam condenses in this latter effect and forms a condensate which is more or less impure. The liquor from the cooking department contains volatile compounds, such as methanol, terpenes and sulphur compounds, which are released from the liquor in each evaporation effect. The impurity which occurs to the greatest extent in the condensate from the black liquor evaporation is methanol. Since methanol is more volatile than water, the liquor steam which is released from the weakest liquor will have the highest content of methanol. Condensates which are formed from liquor steam from stronger liquors contain proportionately much lower contents of methanol. If a liquor steam is allowed to condense out in two stages, a purer condensate and a more contaminated condensate are then formed. This is because the steam which does not condense out in the first stage contains a higher content of methanol and other volatile impurities.

According to the current technique, small constituent flows of the most contaminated evaporation condensates are collected together and conveyed, together with condensate from the cooking department, to a stripper column for a purifying treatment. Evaporation condensate which is purer is collected together separately and either reused in the mill as process water or else discharged. Since the condensates from the different effects possess different degrees of purity, it is also customary, according to the current technique, to mix dirty condensates from one effect which yields relatively pure condensates with a pure condensate from an effect which yields condensates which are more contaminated. This mixed condensate of intermediate purity can also be used in the process or be purified in different ways.

TECHNICAL PROBLEM

The demands for a cleaner environment are nowadays becoming gradually more stringent in most countries. The water which is to be released into rivers and the like must be pure, at least sufficiently pure to ensure that no environmental problems are associated with it. It is no longer acceptable to discharge semi-purified condensate. One way of decreasing the contaminants might be to reuse the condensate in the mill as process water instead of discharging it. However, with such a procedure, the problem then arises that various contaminants accumulate, thereby causing interference in the process and giving rise to problems in the working environment.

For this reason, there has long been a great need within the cellulose industry to be able, on the one hand, to purify the condensates from the black-liquor evaporation aggregates so that they become acceptable for discharge or reuse and, on the other hand, to carry out this purification economically without using several, or very large, so-called stripper columns.

SOLUTION

According to the present invention, a process for evaporating spent liquor or other waste liquids from cellulose cooking, so-called black liquor, sulphite liquor or bleaching department filtrate, has therefore been developed in which the evaporation is performed in several evaporators, so-called effects, where aqueous steam which is driven off from one effect is conveyed onwards into the next effect at a low level, and there, by means of condensation, in its turn drives off further steam from the liquor, and in which the liquor can be conveyed from effect to effect in an arbitrary manner, and in which the aqueous steam contains a variety of relatively low boiling point contaminants, which contaminants are enriched in the steam phase when the steam condenses so that a purer fraction of condensate and a dirtier fraction of condensate, which is more enriched in contaminants, can be taken out separately from each other, which process is characterized in that the purer fraction from one effect is conveyed at a high level into another effect on the steam side where the steam which is arriving is purer than was the steam which was supplied to the effect from which the condensate came.

According to the invention, it is expedient for the dirtier fraction to be supplied, at a high level or at the very top, to another effect on the steam side where the steam which is arriving is more contaminated than was the steam which was supplied to the effect from which the condensate came.

According to the invention, it is expedient for the last effect in the direction of movement of the liquor to be operated using live steam.

According to the invention, it is desirable for the process to be carried out until the pure fraction can either be discharged or returned to the process.

According to the invention, it is expedient for the evaporation process to be performed in a so-called falling film evaporator having one or more vertical partitions between the evaporation tubes.

According to the invention, it is expedient for two or more appliances to be coupled together in series.

DESCRIPTION OF THE FIGURES

The invention will be described in more detail below with reference to the attached drawings, in which.

DETAILED DESCRIPTION

Figure 1:
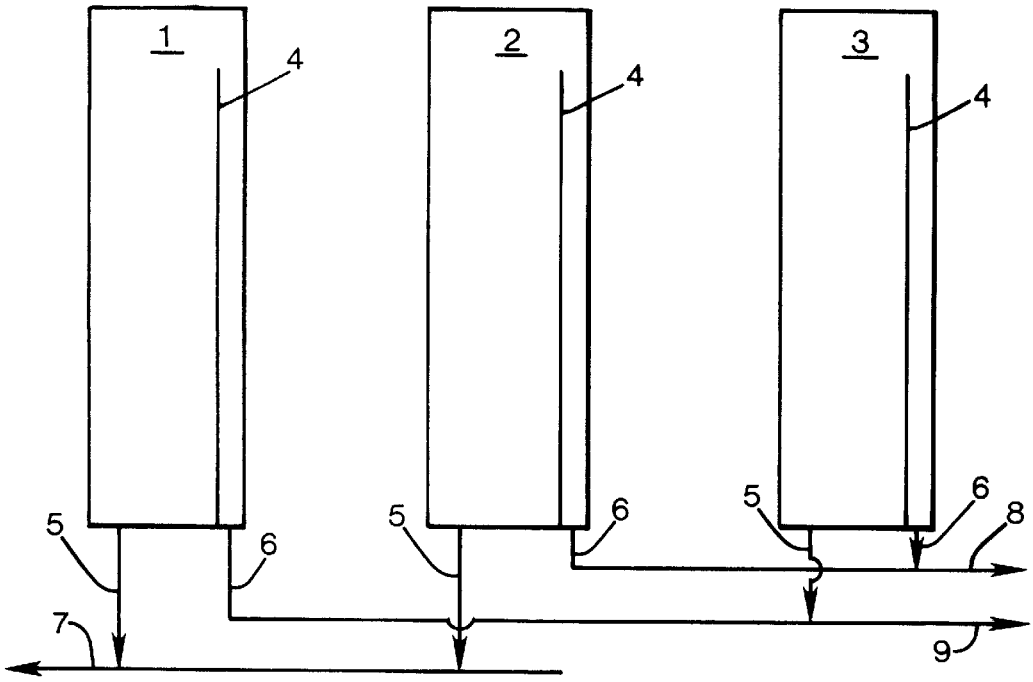
FIG. 1 PRIOR ART
FIG. 1 shows diagrammatically how the condensate streams are recovered using the current technique.

FIG. 1 shows a diagram of three effects which are in accordance with current technique and each of which yields one pure condensate and one dirty condensate. These condensates are neither completely pure nor fully dirty, but instead contain a certain quantity of contaminants which is different for the three effects. These effects, 1, 2 and 3, are assumed to be of the so-called falling film type having vertical tubes, and they are provided with a vertical partition 4 so that pure condensate 5 and dirty condensate 6 can be removed from each of the effects. For the sake of simplicity, the paths taken by the liquor and the steam are not shown in this diagrammatic drawing.

The purest, or least contaminated, constituent streams are those which emanate from the effects which are farthest to the left in the Figure. As can be seen in the Figure, the pure condensates from the two effects which are furthest to the left in the Figure, that is effects 1 and 2, are collected, for possible reuse, in a stream 7, while the dirtiest constituent streams from the right-hand effects, that is 2 and 3, are collected, for forwarding to a stripper, in a constituent stream 8, and the pure constituent stream 5 from effect 3, which is the least pure of the three constituent streams 5, is combined with the least dirty constituent stream 6 from effect 1 in a stream 9, which may be termed medium pure and which must be purified or reused in a process stage which has lower purity requirements.

Figure 2:
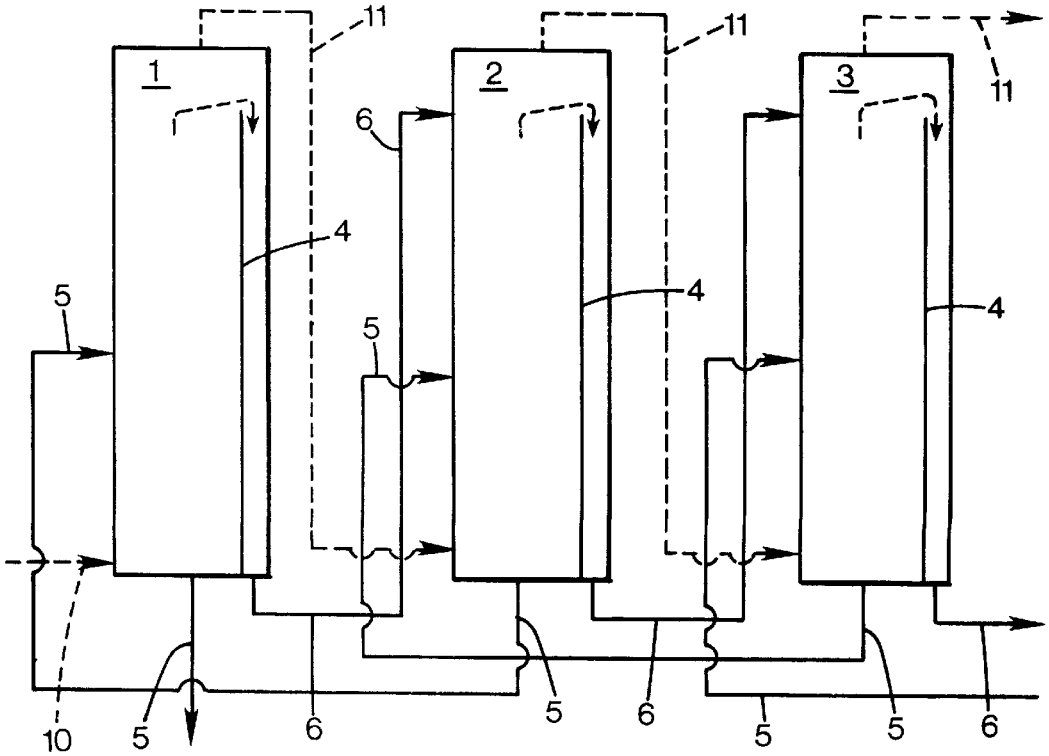
FIG. 2 shows diagrammatically how the condensates are recovered in accordance with the present invention.

FIG. 2, which diagrammatically depicts the process according to the present invention, also shows three effects, with it being assumed that the installation consists of effects both to the right and left of those shown in the Figure. This is known technology. The reference numbers which are given apply to the same elements as those in FIG. 1.

Steam 10, which consists of liquor steam from the preceding effect, is fed into effect 1 in the lower part of the section which yields the purer fraction 5 of the condensates. This steam 10 rises upwards in the effect and meets pure condensate 5 from effect 2, which condensate is fed into effect 1 either at a higher level or at the very top. The steam 10 from the preceding effect contains less volatile compounds than do the condensates 5 from effect 2 and an exchange of volatile compounds will then take place by means of the volatile substances volatilizing and accompanying the steam which passes over into the section for the dirty condensation fraction. The steam which condenses in this section for pure condensate is removed at the bottom and can be conveyed to the preceding effect or to discharge, via heat exchangers or flashing, or back to the process without any purifying treatment. The portion of the steam which passes over the upper edge of the partition 4 condenses in the dirty part. This condensation is virtually complete. An outlet, which is not shown, for non-condensable gases or the like is located in the lower part of this section. This outlet is connected to a vacuum pump.

For the sake of simplicity, the path taken by the liquor into effect 1 is not shown. The steam 11 which the liquor emits is removed from the so-called liquor steam space of the effect via droplet separators (not shown) and fed into the lower part of effect 2, as shown in the Figure. The dirty condensate stream 6 from effect 1 is fed into the top of effect 2 while the pure condensate stream 5 from effect 3 is fed into effect 2 at a lower level. This pure stream 5 can also be fed into the top of effect 2 or can be combined with the dirty constituent stream 6 from effect 1. The course of events in effect 2 and in effect 3 is the same as in effect 1.

Since the pure fractions 5 from each effect meet an even purer steam from the preceding effect, each constituent stream 5 becomes purer the further to the left in the Figure and each constituent stream 6 becomes ever dirtier the further to the right in the Figure.

While the steam 11 is withdrawn from the effect 2, the purer condensate 5 is separated from the more polluted condensate 6 in a steam phase of the effect 2. The more polluted condensate 6 has a concentration of contaminants that is greater than a concentration of contaminants of the purer condensate 5. The withdrawn steam from the effect 2 has a concentration of contaminants that is greater than the concentration of contaminants of the steam withdrawn from the effect 1. The live steam 10 has a concentration of contaminants that is less than the concentration of contaminants of the purer condensate 5 conveyed from the effect 2 to the effect 1.

Figure 3:
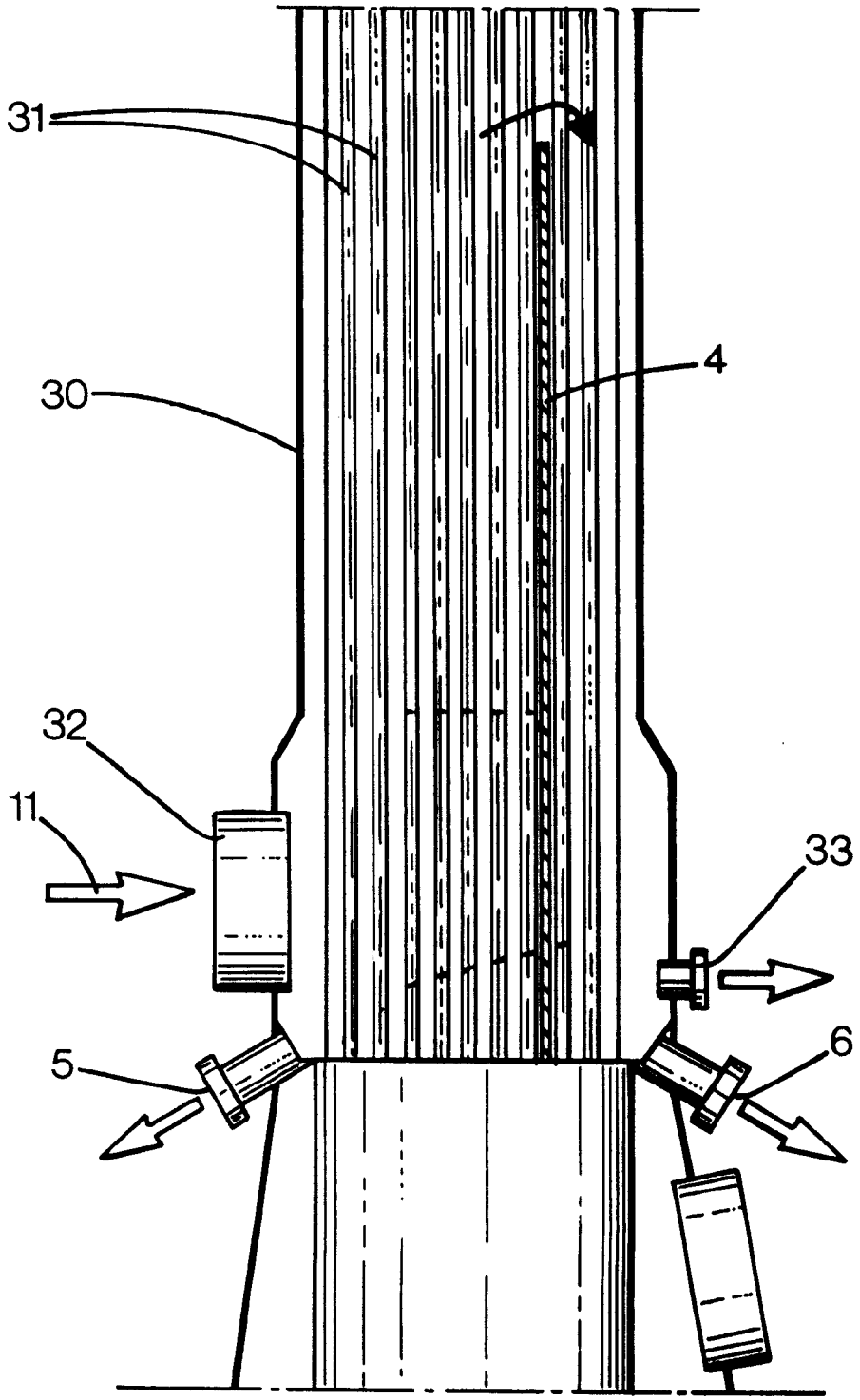
FIG. 3 shows diagrammatically, and in section, an evaporation appliance which can be used in the process according to the present invention.

FIG. 3 shows diagrammatically, and in section, a part of a falling film evaporator in which the present invention can be performed. The evaporator includes a jacket 30 which stands vertically and is normally cylindrical and in which vertical tubes 31 are arranged. The spent liquor which is to be evaporated flows down through these tubes 31, and the tubes are heated by steam between the tubes. According to the invention, this steam is fed in at the lower part 32 of the jacket 30. According to the invention, this steam 11 comes from the preceding effect. The partition 4 is present in the cylindrical jacket 30. On that side of the partition 4 where the steam 11 enters, the latter rises upwards and meets the pure condensate 5 from the next effect and the condensate 6 from the preceding effect, which runs downwards on the outside of the tubes. An exchange of substances takes place during the condensation and the lighter components accompany the steam over into the dirty part of the cylinder on the right-hand side, in the Figure, of the partition 4. Here, the remainder of the steam, including the contaminants, condenses and is removed, as dirty condensate, at 6, while the pure condensate, on the left-hand side of the partition 4, is removed at 5. Gases which cannot be condensed are vented via the valve 33.

Only one partition 4 has been shown in the Figure, which partition 4 divides the space into two parts, a clean part and a dirty part. Several partitions can be arranged in different patterns and can divide up the space into several parts having spaces of identical or different size. This does not imply any departure from the invention but only that the path taken by the steam in the evaporation appliance is extended. This division into several parts can be regarded as several evaporators being assembled together.

In order to provide good contact between the downwardly flowing liquid or condensate and the ascending steam and thereby increase the efficacy of the fractional distillation, the condensates which are arriving can be dispersed uniformly and flow steadily down in step ladders between baffles which hold the tubes. Parts of the heating jacket can be provided with packing material, and the contact between steam and condensate can also be increased with the aid of invaginations or bulges on parts of the tubes. The steam/liquid equilibria are such that the segregation of contaminants is more efficient at relatively low pressure and temperature, for which reason a countercurrent process is to be preferred (yields a high concentration at low pressure).

Thus, the process according to the present invention makes it possible to achieve a much purer fraction than was previously the case and also to achieve a much more contaminated fraction, whose volume is consequently much smaller than previously. This dirty fraction can contain a relatively large quantity of methanol in addition to other contaminants. Apart from the abovementioned advantages of an environmental nature, the advantage is also gained that it is economically much more favourable to handle a quantity of dirty condensate which is smaller as regards its volume.

The process according to the invention also applies to the surface condenser which is used together with effects.

The invention is not limited to the embodiments shown, but can be varied in different ways within the scope of the patent claims.

What is claimed is:

1. A method for evaporating spent liquor from cellulose cooking, the method comprising the steps of:

providing a first evaporator and a second evaporator, each evaporator having a lower portion and an upper portion and each evaporator comprising a fraction of purer condensate and a fraction of more polluted condensate;

withdrawing a first steam from the first evaporator;

conveying the first steam to the lower portion of the second evaporator, the first steam containing low boiling point contaminants;

withdrawing a second steam from the second evaporator;

while withdrawing the second steam, separating the purer condensate from the more polluted condensate in a steam phase of the second evaporator, the more polluted condensate having a concentration of contaminants that is greater than a concentration of contaminants of the purer condensate;

conveying the purer condensate of the second evaporator to the upper portion of a steam side of the first evaporator;

supplying the first evaporator with a third steam, the third steam having less contaminants than the first steam; and conveying the more polluted condensate of the first evaporator to a top portion of a steam side of the second evaporator.

2. The method according to claim 1 wherein the step of supplying the first evaporator with the third steam comprises the step of supplying the first evaporator with a live steam.

3. The method according to claim 1 wherein the step of providing the first and second evaporators comprises the step of providing first and second falling film evaporators each having at least one vertical partition disposed between evaporation tubes.

4. The method according to claim 1 wherein the method further comprises the step of providing a third evaporator coupled in series with the first and the second evaporator.

5. A method for evaporating spent liquor from cellulose cooking, the method comprising the steps of:

providing a first evaporator and a second evaporator, each evaporator having a lower portion and an upper portion, the first evaporator having a first purer condensate and a first more polluted condensate and the second evaporator having a second purer condensate and a second more polluted condensate;

withdrawing a first steam from the first evaporator;

conveying the first steam to the lower portion of the second evaporator, the first steam having a first concentration of contaminants;

withdrawing a second steam from the second evaporator, the second steam having a second concentration of contaminants that is greater than the first concentration of contaminants of the first steam;

separating the second purer condensate from the more polluted second condensate in the second evaporator, the second more polluted condensate having a concentration of contaminants that is greater than a concentration of contaminants of the first purer condensate;

conveying the second purer condensate to the upper portion of the first evaporator;

conveying the second purer condensate downwardly in the first evaporator;

supplying a fresh steam to the lower portion of the first evaporator, the fresh steam having a concentration of contaminants that is less than the concentration of contaminants of the second purer condensate conveyed from the second evaporator;

conveying the fresh steam upwardly in the first evaporator;

exposing the downwardly moving second purer condensate to the upwardly moving fresh steam and reducing the concentration of contaminants of the second purer condensate; and conveying the first more polluted condaenate to the second evaporator.

6. The method according to claim 5 wherein the method further comprises the steps of;

providing a third evaporator;

supplying the second steam and the second more polluted condensate to the third evaporator;

exposing the second more polluted condensate to the second steam and reducing the concentration of contaminants of the second more polluted condensate;

forming a third purer condensate from the second more polluted condensate;

withdrawing the third purer condensate from the third evaporator; and conveying the third purer condensate to the second evaporator.

* * * * *